United States Patent [19]

Hurst, Jr.

[11] 4,090,273

[45] May 23, 1978

[54] DETENT FOR MECHANICAL LINKAGE

[76] Inventor: George H. Hurst, Jr., 16491 Harbour La., Huntington Beach, Calif. 92649

[21] Appl. No.: 775,780

[22] Filed: Mar. 9, 1977

[51] Int. Cl.[2] ..... E05D 11/06; E05D 11/08

[52] U.S. Cl. ..... 16/144; 16/145; 16/141; 74/532; 74/540; 74/541

[58] Field of Search ..... 74/527, 529, 532, 540, 74/541; 16/139, 140, 141, 50, 65

[56] References Cited

U.S. PATENT DOCUMENTS

| | | | |
|---|---|---|---|
| 2,206,909 | 7/1940 | Lustig | 74/532 |
| 2,485,015 | 10/1949 | Radtke | 74/532 |
| 3,124,830 | 3/1964 | Gionet | 16/140 |
| 3,381,332 | 5/1968 | Jerila et al. | 16/139 |
| 3,438,083 | 4/1969 | Kirk | 16/139 |
| 3,837,040 | 9/1974 | Keller et al. | 16/145 |

*Primary Examiner*—Leonidas Vlachos
*Attorney, Agent, or Firm*—Christie, Parker & Hale

[57] ABSTRACT

A movable linkage has a surface of travel in which a generally V-shaped notch with edges is formed. A rotatable cam follower has first and second sides meeting to form a corner that fits in the notch. One of the sides of the cam follower is urged by a spring against the surface of travel of the linkage. The spring force acts in a direction transverse to one side of the notch and along the other surface of the notch. An arcuate concave relief on the first side of the cam follower adjacent to the corner is shaped to embrace one edge of the notch without such edge bottoming on the cam follower as the corner of the cam follower enters the notch.

26 Claims, 14 Drawing Figures

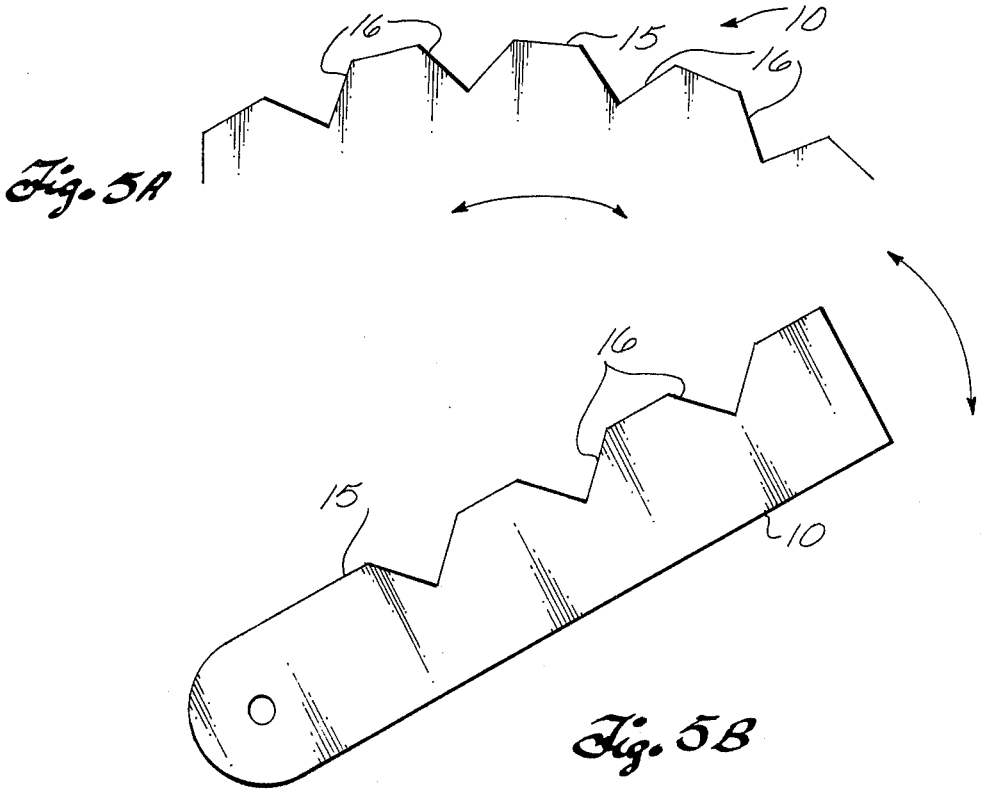
Fig. 5A
Fig. 5B
Fig. 6
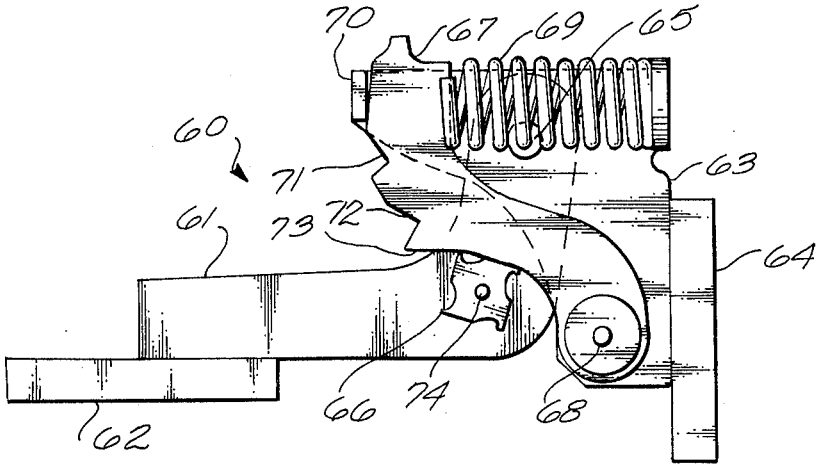

DETENT FOR MECHANICAL LINKAGE

BACKGROUND OF THE INVENTION

This invention relates to mechanisms and, more particularly, to an improved detent for a mechanical linkage.

One type of detent for a mechanical linkage is engaged as the linkage moves into a locked position and is disengaged as a force is applied to the linkage that is greater than the normal moving force, i.e., the moving force when the detent is not engaged. A well known application of this type of detent is the mechanism for holding a car door in its open position, which comprises a roller and a spring-loaded pivot arm with one or more arcuate recesses. As the car door opens, the pivot arm moves across the roller until the roller drops in a recess, which locks the car door in the open position. To disengage the detent, sufficient force must be applied to the car door to move the pivot arm against the spring loading until the roller is "lifted" out of the recess. This same spring loading, which serves the desired purpose of holding the door in the locked position, prematurely forces the car door into the locked position during opening as soon as the roller begins to enter the recess. As a result, the car door moves out of control of the person opening it a distance that is greatly magnified at the unhinged edge of the car door. On the other hand, if too little spring loading is employed, the car door may accidently slip out of the locked position, causing personal injury. Approximately the same unlocking force is required to close the door as to open it from a locked intermediate open position to a fully open position — thus, the door either opens with too much difficulty or closes too easily, depending upon the spring loading selected.

SUMMARY OF THE INVENTION

The invention concerns a detent of the above described type for a mechanical linkage in which the linkage moves gradually into the locked position without appreciable loss of control prior to arriving at the locked position. A movable linkage has a surface of travel in which one or more generally V-shaped notches with edges and a vertex are formed. A rotatable cam follower has first and second sides meeting to form a corner that fits in the notches. The cam follower and the surface of travel of the linkage are urged together by a spring. An arcuate concave relief on one side of the cam follower adjacent to the corner is shaped to embrace one edge of the notch without such edge bottoming on the cam follower as the corner of the cam follower enters the notch. Accordingly, as the detent is engaged, the edges of the relief follow the surface of travel including the notch, which serves as a cam surface to gradually ease the corner of the cam follower into the notch without loss of control. Preferably, the width of the relief is slightly less than one-half the distance from one edge to the vertex of the notch.

A feature of the invention is the operation of the spring force against the cam follower in a direction transverse to one surface of the notches and along the other surface of the notches. Consequently, when the linkage is in the locked position a greater force is required to disengage the detent in one direction than in the other direction.

BRIEF DESCRIPTION OF THE DRAWINGS

The features of specific embodiments of the best mode contemplated of carrying out the invention are illustrated in the drawings, in which:

FIGS. 5A and 5B are alternative embodiments of the mechanical linkage of FIG. 1; and FIG. 6 is a schematic diagram of a car door incorporating the principles of the invention.

DETAILED DESCRIPTION OF THE SPECIFIC EMBODIMENTS

Figure 1:
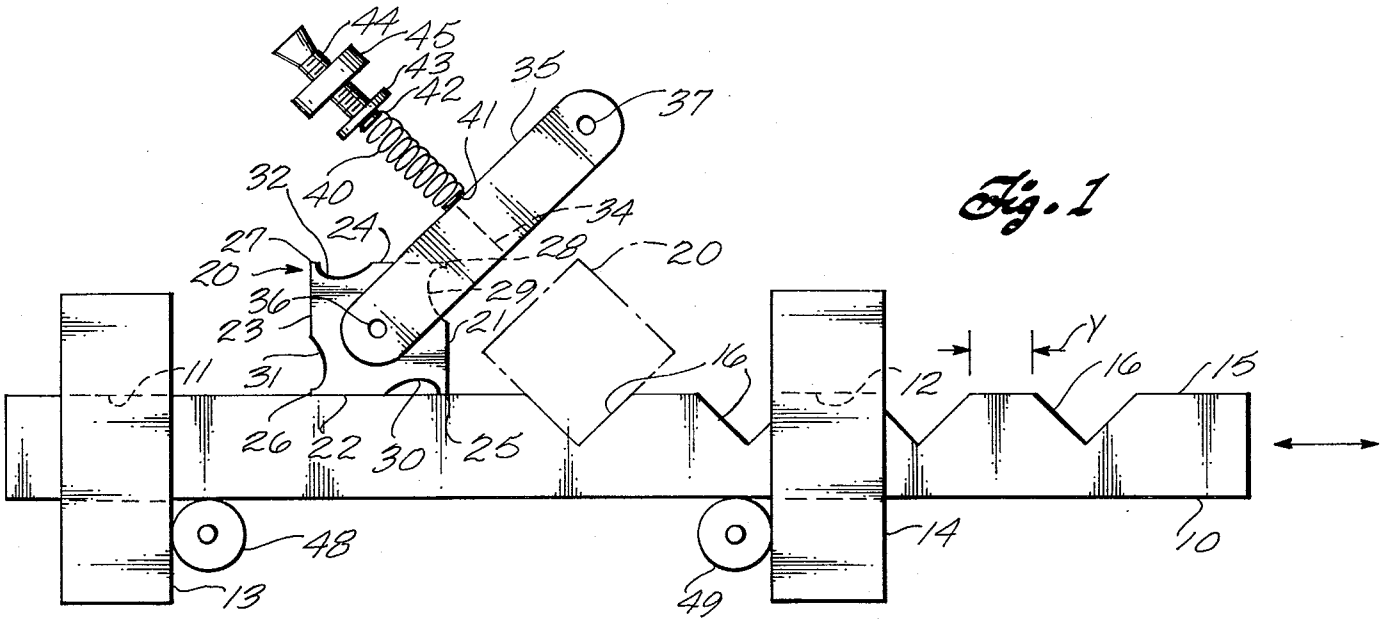
FIG. 1 is a side elevation view of one embodiment of the invention.

In FIG. 1, a long straight mechanical linkage 10 rides in slots 11 and 12 of stationary guide members 13 and 14, respectively. As a result, linkage 10 is free to move in translation back and forth horizontally, as indicated by the two-headed arrow in FIG. 1. Linkage 10 has a straight surface of travel 15, in which a plurality of spaced, generally V-shaped notches 16 are formed. The sides of each notch 16 form a right angle vertex with each other and a sharp 45° angle edge with surface 15. A cam follower 20 has sides 21, 22, 23, and 24. Sides 21 and 22 meet to form a right angle corner 25; sides 22 and 23 meet to form a right angle corner 26; sides 23 and 24 meet to form a right angle corner 27; and sides 21 and 24 meet to form a right angle corner 28. Corners 25 through 28 fit in notches 16, as depicted by the phantom representation of cam follower 20 in FIG. 1. Arcuate concave reliefs 29, 30, 31, and 32 are formed on the sides of cam follower 20. Preferably, each relief is adjacent to a corner, as shown, rather than coinciding with the corner, which would result in a sharp edge at the corner. Such a sharp edge would tend to wear down during use. In contrast, by locating each relief closely adjacent to the corresponding corner, as shown, a short flat wear surface is formed instead of a sharp edge. Relief 29 is on side 21 closely adjacent to corner 28; relief 30 is on side 22 closely adjacent to corner 25; relief 31 is on side 23 closely adjacent to corner 26; and relief 32 is on side 24 closely adjacent to corner 27. Cam follower 20 is mounted in a yoke 34 at one end of a pivot arm 35 for rotation in yoke 34 about a shaft 36. The other end of pivot arm 35 is mounted for rotation on a pin 37.

Pivot arm 35 is spring loaded by a spring 40 held between a spring keeper 41 attached to pivot arm 35 and a spring keeper 42 attached to a disc 43. Disc 43 is attached to the end of an adjusting screw 44 which has a threaded connection with a stationary support 45. As screw 44 is turned, the deformation of spring 40 and, thus, the amount of loading of pivot arm 35 varies. Spring 40 urges pivot arm 35 in a counterclockwise direction, as viewed in FIG. 1, which urges cam follower 20 against surface of travel 15 of linkage 10 at an angle of approximately 45° to surface of travel 15, i.e., parallel to one surface of notches 16 and perpendicular to the other surface thereof. Linkage 10 is urged by spring 40 against rollers 48 and 49, which reduce friction as linkage 10 moves back and forth.

Reference is made to FIG. 2 for a description of the way in which the detent of FIG. 1 becomes engaged. While the detent is disengaged, i.e., between notches 16, cam follower 20 rides flat on surface of travel 15. As a corner of cam follower 20, namely, corner 25 in FIG. 2A, reaches the edge of notch 16 during movement of linkage 10, cam follower 20 remains flat until the corner of notch 16 enters relief 30. FIG. 2A depicts cam follower 20 at the point where the edge of notch 16 is about to enter relief 30, i.e., where it coincides with the leading edge 30*a* of relief 30. During further movement of linkage 10, corner 25 follows the surface of notch 16 and cam follower 20 tilts, as depicted in FIG. 2B. Consequently, trailing edge 30*b* of relief 30 follows the flat portion of surface of travel 15 as leading edge 30*a* follows the surface of notch 16. These are the only two areas of contact between cam follower 20 and surface of travel 15 during the entry of cam follower 20 into notch 16. Relief 30 is shaped so the edge of notch 16 does not bottom thereon, i.e., does not touch cam follower 20, or at least does not interfere with the maintenance of the two contact areas just described. Preferably, the depth of notch 16 as measured from edge to vertex is equal to one-half the length of a side (21, 22, 23, 24) of cam follower 20, and the width of relief 30 plus the width of the wear surface at corner 25, labeled X in FIG. 2A, is slightly less than the depth of notch 16 as measured from vertex to edge. As depicted in FIG. 2C, corner 25 approaches the vertex of notch 16 as the edge of notch 16 approaches trailing edge 30*b* of relief 30. The point at which trailing edge 30*b* of relief 30 coincides with the edge of notch 16, which is an unstable position, is illustrated in FIG. 2D. At such point, the force of spring 40 pushes cam follower 20 fully into notch 16, thereby seating corner 25 in the vertex of notch 16, locking cam follower 20 in position, and engaging the detent. This action produces an audible indication or click. The further cam follower 20 travels after trailing edge 30*b* of relief 30 passes the edge of notch 16 before corner 25 seats in the vertex of notch 16, the louder is the click.

Figure 2A:
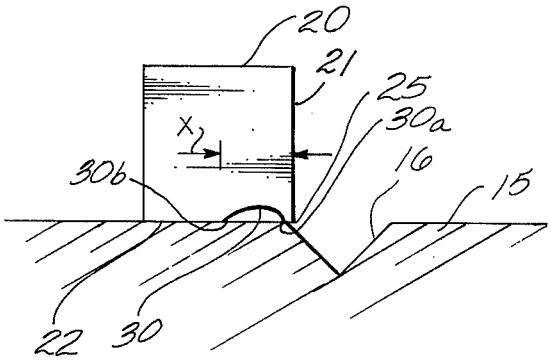
FIGS. 2A through 2D are diagrams depicting the cam follower of FIG. 1 during different stages of entry of the corner into the notch.
Figure 2B:
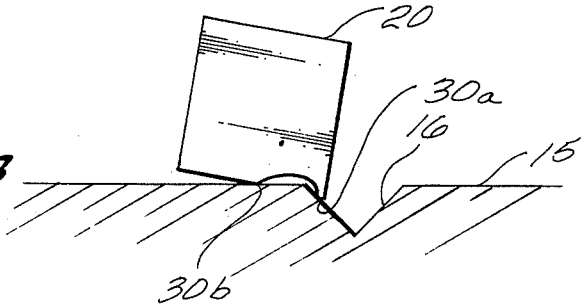
Figure 2C:
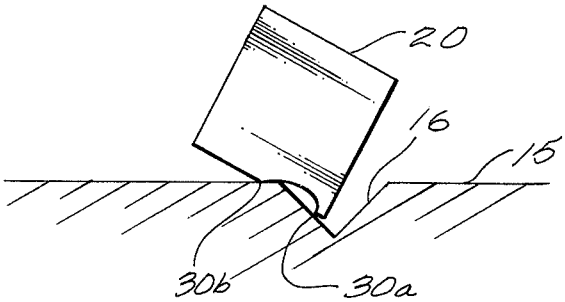
Figure 2D:
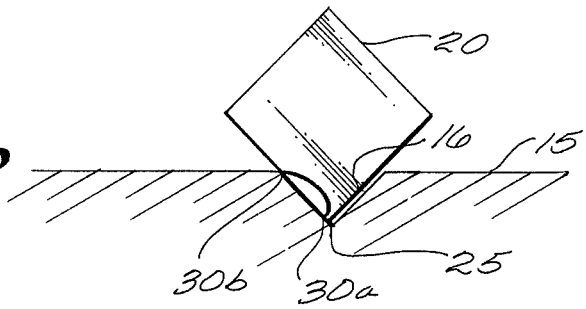

The only portion of the entry of cam follower 20 into notch 16 during which cam follower 20 moves out of control is the short distance represented in FIG. 2D between corner 25 when trailing edge 30*b* of relief 30 coincides with the edge of notch 16 and the vertex of notch 16. Cam follower 20 is pushed through this distance, so to speak, by spring 40, until corner 25 comes to rest at the vertex of notch 16 fully seated therein with sides 22 and 21 in contact with the sides of notch 16. From the point of view of minimizing the distance of out-of-control movement during engagement of the detent, it is desirable that the relief be wide enough to completely guide corner 25 into notch 16. From the point of view of holding the detent in engagement against accidental forces, it is desirable for relief 30 to lie completely within notch 16 when the detent is engaged; otherwise, cam follower 20 will slide out of notch 16 as easily as it slides in. These two considerations dictate that the distance X in FIG. 2A be smaller than the depth of notch 16 as measured from vertex to edge, but as close as practicable thereto within the limits of manufacturing capability.

As a trade-off, if a louder click is desired to apprise the user of the engagement of the detent, then the distance X can be made somewhat smaller than the depth of notch 16 as measured from vertex to edge. The louder click, however, is obtained at the expense of a larger out-of-control movement.

By virtue of the angle at which the force of spring 40 is exerted on cam follower 20, a larger force is required to disengage the detent in one direction than in the other direction. When cam follower 20 is in the locked position in notch 16, a large unlocking force is required to unlock cam follower 20 by moving linkage 10 to the right, as viewed in FIG. 1, called hereafter the direction of large resistance. In contrast, a small unlocking force is required to move linkage 10 to the left, as viewed in FIG. 1, called hereafter the direction of small resistance. In contrast to an inline spring, spring 40 requires a larger unlocking force in the direction of high resistance to move cam follower 20 out of the locked position in notch 16 for a given spring constant. The described differential unlocking force is maximized by placement of pivot arm 35, as shown, to urge cam follower 20 against surface of travel 15 of linkage 10 at an angle of approximately 45° to surface of travel 15, i.e., so the spring force acts perpendicular to one side of notches 16 and parallel to the other side of notches 16. Other angles also provide a differential unlocking force to a lesser degree as long as the angle is such that the spring force is exerted generally transverse to one surface of notches 16 and along the other surface of notches 16. Other ways to vary the unlocking force are by selecting a different spring constant for spring 40 and changing the depth of notches 16.

Figure 3C:
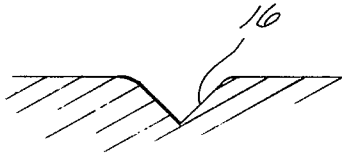
FIGS. 3A through 3C are alternative embodiments of the notches in FIG. 1.
Figure 3A:
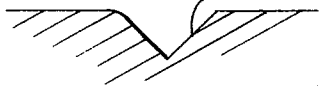
Figure 3B:
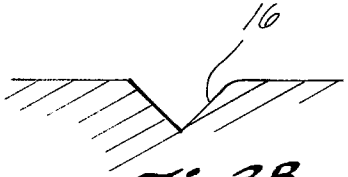

Another way to vary the unlocking force is to round the edges of notches 16. As shown in FIG. 3A, the left edge of notch 16 is rounded, which reduces the unlocking force in the direction of large resistance. As shown in FIG. 3B, the right edge of notch 16 is rounded, which reduces the unlocking force in the direction of low resistance. As shown in FIG. 3C, both edges of notch 16 are rounded, which reduces the unlocking force in the direction of high resistance and in the direction of low resistance.

A separate notch 16 is provided for each locked position desired for the detent. When cam follower 20 lies in one notch 16, upon application of the unlocking force, it moves out of such notch 16 and rides flat on the surface of travel 15 to the next notch 16, which cam follower 20 enters in the same manner described above in connection with FIGS. 2A through 2D. The spacing between notches 16, designated Y in FIG. 1, must be at least as large as one-half the length of each side of cam follower 20, in order to enable cam follower 20 to ride flat on surface of travel 15 between notches 16.

Figure 4B:
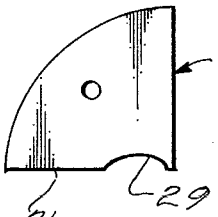
FIGS. 4A through 4C are alternative embodiments of the cam follower of FIG. 1.
Figure 4C:
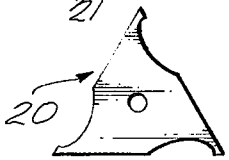
Figure 4A:
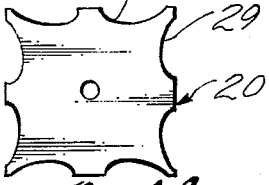

In some applications, it is desirable to permit controlled entry of the corners of cam follower 20 into notches 16 from both directions of approach. In such case, reliefs are located closely adjacent to and on each side of the corners of cam follower 20, as illustrated by reliefs 29 and 29' in FIG. 4A. In other applications, cam follower 20 will reciprocate back and forth, fitting in only a single notch. In such case, only two sides of cam follower 20 slide along surface of travel 15 and fit in notch 16, so cam follower 20 need only have two operative sides, namely, sides 21 and 22, as illustrated in FIG. 4B. The shape of the remaining side or sides is not important. In other applications, it may be desirable to provide notches 16 with a different angle, such as for example, a 60° angle. In such case, the corners of cam follower 20 would also have corresponding corners, as depicted by the triangular shape in FIG. 4C.

Linkage 10 may assume other shapes and undergo other types of motion than illustrated in FIG. 1. For example, as shown in FIG. 5A, linkage 10 can comprise a rotatable wheel in which notches 16 are formed. In such case, surface of travel 15 is generally circular. Alternatively, linkage 10 can be a pivot arm in which notches 16 are formed. The surface of travel 15 could be either straight or curved.

FIG. 6 illustrates the application of the invention to a car door. A conventional car door hinge 60 has a bracket 61 attached to the cowl 62 of the car, and a bracket 63 attached to the door 64 of the car. Brackets 61 and 63 are joined by a hinge 65, about which the car door pivots. The only differences from a conventional car door hinge are as follows: a four-sided cam follower 66 replaces the conventional roller of the car door hinge, and a linkage 67 replaces the conventional linkage, which has one or more arcuate recesses. Linkage 67 is supported for rotation by a pivot pin 68. Spring 69, which does not need to have as large a spring constant as the conventional spring employed in a car door hinge, urges the other end of linkage 67 in a counterclockwise direction, as viewed in FIG. 5, against a stop 70. V-shaped notches 71 and 72, which are the same as those described in FIG. 1, lie along a surface of travel 73 of linkage 67. The sides of notches 71 and 72 are oriented so the force of spring 69, when cam follower 66 is locked in notch 71 or 72, acts on linkage 67 perpendicular to one side of notches 71 and 72, i.e., the side nearer pin 68, and parallel to the other side of notches 71 and 72, i.e., the side nearer spring 69. This is accomplished by orienting one side of notches 71 and 72 parallel to the radius of rotation of linkage 67 about pin 68 and the other side of notches 71 and 72 perpendicular to such radius. Cam follower 66, which is identical to cam follower 20 in FIG. 1, is mounted for rotation on a pin 74. As the car door is opened from a closed position, linkage 67 is pushed off stop 70 by cam follower 66 and spring 69 is depressed. In other words, spring 69 urges surface of travel 73 against cam follower 66. Thus, cam follower 66 rides flat on surface of travel 73 until the corner of cam follower 66 reaches the edge of notch 72. At that point, the corner of cam follower 66 enters notch 72 in the manner described in connection with FIGS. 2A through 2D to engage the detent. Because of the direction of the force exerted by spring 69 on linkage 67 in the locked position, a smaller unlocking force is required to open the door further, i.e., to push notch 71 toward cam follower 66, than to close the door, i.e., to push notch 72 out of cam follower 66 in the direction of pin 68. Consequently, the door is not likely to close accidentally, but can be opened further without the application of undue force. In summary, because of the reliefs on cam follower 66, the detent becomes engaged without loss of control and remains positively engaged, without appreciable risk of accidental door closure.

The described embodiments of the invention are only considered to be preferred and illustrative of the invention concept; the scope of the invention is not to be restricted to such embodiments. Various and numerous other arrangements may be devised by one skilled in the art without departing from the spirit and scope of this invention. For example, if one is interested in providing a detent with differential unlocking force without eliminating the uncontrolled movement during engagement, the reliefs on the cam follower could be eliminated. Similarly, if one is not concerned with providing a differential unlocking force, the spring force could be exerted on the cam follower in directions other than transverse to one side of the notches.

I claim:

1. A detent for a mechanical linkage comprising:

a movable linkage having a surface of travel in which a generally V-shaped notch with edges and a vertex is formed;

a rotatable cam follower having first and second sides meeting to form a corner that fits in the notch;

means for urging the cam follower and the surface of travel of the linkage against each other; and an arcuate concave relief on the first side of the cam follower adjacent to the corner, the relief being shaped to embrace one edge of the notch without such edge bottoming on the cam follower as the corner of the cam follower enters the notch from a given direction.

2. The detent of claim 1, in which the width of the relief is less than one-half the distance from one edge to the vertex of the notch.

3. The detent of claim 1, in which the surface of travel of the linkage is straight.

4. The detent of claim 1, in which the surface of travel of the linkage is curved.

5. The detent of claim 1, in which the linkage is rotationally movable and the surface of travel is circular.

6. The detent of claim 1, in which the linkage is pivotably movable and the surface of travel is straight.

7. The detent of claim 1, in which both edges of the notch are sharp.

8. The detent of claim 1, in which one edge of the notch is sharp and the other edge of the notch is rounded.

9. The detent of claim 1, in which both edges of the notch are rounded.

10. The detent of claim 1, additionally comprising a second arcuate concave relief on the second side of the cam follower adjacent to the corner, the second relief being shaped to embrace one edge of the notch without such notch bottoming on the second relief as the corner of the cam follower enters the notch from a direction opposite to the given direction.

11. The detent of claim 1, in which the notches in the corner are approximately right angles, the cam follower additionally has third and fourth sides, the second and third sides meeting to form a second corner approximately at a right angle, the third and fourth sides meeting to form a third corner approximately at a right angle, and the fourth and first sides meeting to form a fourth corner approximately at a right angle; and the detent additionally comprises second, third, and fourth arcuate concave reliefs on the second, third, and fourth sides, respectively, of the cam follower adjacent to the corners, the second, third, and fourth reliefs being shaped to embrace one edge of the notch without such notch bottoming on the reliefs as their respective corners of the cam follower enter the notch.

12. The detent of claim 1, in which the cam follower has a third side interconnecting the first and second sides.

13. The detent of claim 12, in which the third side is semicircular.

14. The detent of claim 12, in which the third side is approximately flat and the detent additionally comprises second and third arcuate concave reliefs on the second and third sides, respectively, of the cam follower adjacent to the corners, the second and third reliefs being shaped to embrace one edge of the notch without such notch bottoming on the reliefs as the respective corners of the cam follower enter the notch.

15. The detent of claim 1, in which the urging means urges the cam follower and the surface of travel of the linkage against each other in a direction transverse to one side of the notch and along the other side of the notch.

16. The detent of claim 1, in which the urging means urges the cam follower and the surface of travel of the linkage against each other in a direction perpendicular to one side of the notch and parallel to the other side of the notch.

17. The detent of claim 1, in which the linkage has a plurality of generally V-shaped notches spaced apart from each other and a distance at least as large as one-half the length of the first and second sides.

18. The detent of claim 1, in which the depth of the notch from vertex to edge is approximately one-half the length of the first and second sides.

19. The detent of claim 1, additionally comprising a pivot arm mounted to pivot at one end, the pivot arm approaching the surface of travel at an angle transverse to one side of the notch and along the other side of the notch, the cam follower being mounted for rotation on the other end of the pivot arm, and the urging means comprising a spring urging the pivot arm against the linkage.

20. A detent for a car door hinge comprising:

a first bracket attached to the car door;

a second bracket attached to the cowl of the car;

a hinge interconnecting the first and second brackets;

a linkage having a surface of travel in which a generally V-shaped notch with edges and a vertex is formed;

means for pivotably mounting one end of the linkage on one of the brackets;

a cam follower having first and second sides meeting to form a corner that fits in the notch;

means for rotatably mounting the cam follower on the other bracket; and means for urging the cam follower and the surface of travel of the linkage against each other.

21. The detent of claim 20, additionally comprising an arcuate concave relief on the first side of the cam follower adjacent to the corner, the relief being shaped to embrace one edge of the notch without such edge bottoming on the cam follower as the corner of the cam follower enters the notch during door opening.

22. The detent of claim 21, in which the notch is oriented so that when the corner fits in the notch the urging means urges the cam follower and the surface of travel against each other in a direction transverse to one side of the notch and along the other side of the notch.

23. The detent of claim 22, in which the urging means urges the cam follower and the surface of travel against each other in a direction transverse to the side of the notch nearer the one end of the linkage.

24. The detent of claim 23, additionally comprising a second notch on the linkage oriented so that when the corner fits in the second notch and the urging means urges the cam follower and the surface of travel against each other in a direction transverse to the side of the second notch nearer the one end of the linkage and along the other side of the notch.

25. The detent of claim 24, in which the notches in the corner are approximately right angles, the cam follower additionally has third and fourth sides, the second and third sides meeting to form a second corner approximately at a right angle, the third and fourth sides meeting to form a third corner approximately at a right angle, and the fourth and first sides meeting to form a fourth corner approximately at a right angle; and the detent additionally comprises second, third, and fourth arcuate concave reliefs on the second, third, and fourth sides, respectively, of the cam follower adjacent to the corners, the second, third, and fourth reliefs being shaped to embrace one edge of the notch without such notch bottoming on the reliefs as their respective corners of the follower enter the notch.

26. The detent of claim 21, in which the notch is oriented so that when the corner fits in the notch the urging means urges the cam follower and the surface of travel against each other in a direction perpendicular to one side of the notch and parallel to the other side of the notch.

* * * * *